US007079919B2

(12) United States Patent
Gerritsen et al.

(10) Patent No.: US 7,079,919 B2
(45) Date of Patent: Jul. 18, 2006

(54) METHOD FOR SETTING THE TRAVEL OF A PRESS BRAKE

(75) Inventors: Gerrit Gerritsen, Dizy (CH); Piero Papi, Cheseaux (CH)

(73) Assignee: Bystronic Laser AG, Niederonz (CH)

( * ) Notice: Subject to any disclaimer, the term of this patent is extended or adjusted under 35 U.S.C. 154(b) by 0 days.

(21) Appl. No.: 10/472,068

(22) PCT Filed: Mar. 15, 2002

(86) PCT No.: PCT/CH02/00154

§ 371 (c)(1),
(2), (4) Date: Sep. 16, 2003

(87) PCT Pub. No.: WO02/074463

PCT Pub. Date: Sep. 26, 2002

(65) Prior Publication Data

US 2004/0111177 A1 Jun. 10, 2004

(30) Foreign Application Priority Data

Mar. 16, 2001 (CH) ..... 490/01

(51) Int. Cl.
*G06F 19/00* (2006.01)
*B30B 15/26* (2006.01)
*B21C 51/00* (2006.01)

(52) U.S. Cl. ..... 700/165; 700/206; 100/43; 73/31.11

(58) Field of Classification Search ..... 700/165, 700/206, 173, 188, 190, 193; 100/43, 46, 100/50; 72/31.11, 31.12
See application file for complete search history.

(56) References Cited

U.S. PATENT DOCUMENTS

| | | | | |
|---|---|---|---|---|
| 4,408,471 | A | 10/1983 | Gossard et al. | |
| 4,511,976 | A | 4/1985 | Graf | |
| 4,550,586 | A * | 11/1985 | Aubert et al. | 72/389.3 |
| 4,819,467 | A * | 4/1989 | Graf et al. | 72/20.1 |
| 5,269,163 | A * | 12/1993 | Yagi et al. | 100/43 |
| 5,483,750 | A * | 1/1996 | Ooenoki et al. | 33/534 |
| 5,493,959 | A * | 2/1996 | Yagi et al. | 72/389.5 |
| 6,192,732 | B1 * | 2/2001 | Kojima | 72/389.5 |
| 6,581,427 | B1 * | 6/2003 | Gerritsen | 72/31.11 |
| 6,871,521 | B1 * | 3/2005 | Sperrer | 72/21.1 |
| 2001/0009106 | A1 | 7/2001 | Gerritsen | |

FOREIGN PATENT DOCUMENTS

CH 686119 A 1/1996

(Continued)

*Primary Examiner*—Paul Rodriguez
(74) *Attorney, Agent, or Firm*—Clifford W. Browning

(57) ABSTRACT

A method for setting the travel of a press brake comprising at least one sensor, which measures a physical parameter (p) that varies with the force exerted by the punch on a piece of sheet metal placed on the die, and an electronic device that controls the displacement of the mobile apron. Instantaneous bending angle α under load of the piece is calculated as a function of the displacement; the bearing force (f) of the punch on the piece is calculated using the value of the physical parameter (p); the sequence of values for the instantaneous bending angle/bearing force pair (α, f) is compared to a reference curve $(\alpha, f)_{ref}$ which is pre-recorded during a bending operation involving the same material, and the electronic device calculates a bottom dead center correction taking account of the deviation between the (α, f) pairs and reference curve $(\alpha, f)_{ref}$.

8 Claims, 5 Drawing Sheets

FOREIGN PATENT DOCUMENTS

| | | | |
|---|---|---|---|
| CH | 686119 | A5 | 1/1996 |
| JP | 02030327 | | 1/1990 |
| JP | 02030327 | A | 1/1990 |
| JP | 05138254 | | 1/1993 |
| JP | 09136116 | | 5/1997 |
| JP | 10052800 | | 2/1998 |
| WO | WO 9510370 | A | 4/1995 |
| WO | WO 0160541 | A | 8/2001 |

* cited by examiner

METHOD FOR SETTING THE TRAVEL OF A PRESS BRAKE

The present invention relates to a method for adjusting the stroke of a press brake comprising a fixed table carrying a die, a moving beam carrying a punch, means of moving the moving beam, the said movement means bearing on uprights fixed to the fixed table, measuring rules for measuring the movement (d) of the moving beam with respect to the uprights, at least one sensor measuring a physical parameter (p) varying according to the force exerted by the said punch on a piece of nominal thickness (e) which is to be bent at a set angle $\alpha_c$ placed on the said die, and an electronic control device controlling the movement of the moving beam between a top dead center and a bottom dead center (BDC), provided with means of acquiring the movement measurements (d) and the physical parameter (p), and calculation means for correcting the value of the said bottom dead center according to the measurements of the said movement (d) and the said physical parameter (p).

DESCRIPTION OF RELATED ART

The patent CH 686119 of the applicant describes a press brake of this type. When a metal sheet is bent, the force undergone by the uprights of a press under the effect of the thrust of the rams causes a flexion of the uprights which may result in a deformation of the frame of up to 1–2 mm. This flexion modifies the depth of penetration of the punch into the die, which creates an error in the bending angle obtained on the piece to be bent. In the adjustment method according to CH 686119, using pressure sensors, the force undergone by each of the uprights under the action of the means of moving the moving beam is determined, each of the values obtained is compared with a predetermined diagram establishing the relationship between the force undergone by the respective upright and the stroke of the slide is increased so as to compensate for the deformations on the press.

Another parameter liable to give rise to an error in the bending angle is the variability of the thickness of the piece being processed. The nominal thickness of the piece is one of the parameters introduced into the control electronics of the press brake when the stroke is initially adjusted.

For the actual value $\alpha_r$ of the bending angle not to deviate from the set value $\alpha_c$, the actual thickness $e_r$ of the metal sheet must be taken into account at each bending operation. This is because the manufacturers of sheet metal supply metal sheets whose actual thickness has variations which may range up to ±10% of the nominal value (e) of the thickness. If a sheet with a nominal thickness of 2 mm must, for example, be bent at 90° in a V-shaped opening of 12 mm, a variation in the thickness of 10% will, if it is not corrected, give rise to a variation in the bending angle of 2°; without appropriate correction, the bending angle could vary between 88° and 92°.

The patent application JP 02030327 proposes to determine the actual thickness of the piece to be bent by the concomitant detection of the increase in the hydraulic pressure by a first sensor and the position of the punch by a second sensor.

The patent applications JP 05138254, JP 10052800 and JP 09136116 propose to determine the thickness of the piece to be bent by detecting a variation in descent speed of the moving beam occurring at the moment when the punch comes into contact with this piece.

The patent U.S. Pat. No. 4,550,586 proposes to determine the thickness of the piece to be bent by detecting the loss of contact of this piece with sensors placed on the surface of the fixed table, the loss of contact resulting from the start of the bending process.

Another problem which is posed during a bending process is the compensation for the spring effect, that is to say the elastic return of the bent piece at a slightly lesser bending angle when the pressure of the punch is released. Because of this effect, the maximum value of the instantaneous bending angle under a load $\alpha_{max}$ must be greater than the set value $\alpha_c$ of the required bending angle after release of the bent piece. It is known in the state of the art how to empirically determine a mean difference ($\alpha_{max}-\alpha_c$) and to apply the corresponding correction to the stroke in a constant manner during a series of repetitive bendings. However, this type of method does not take account of the variability in the material to be processed, in particular variations in thickness of the sheet metal and its modulus of elasticity, which can vary according to the direction of rolling. The variations in these parameters modify the magnitude of the spring effect from one piece to another, so that a constant correction is not sufficient.

To take account of the variations in these parameters, the patent U.S. Pat. No. 4,408,471 proposes to record the variation in the force exerted by the punch on the piece according to its movement, to deduce the modulus of elasticity of the piece from the slope on the initial rectilinear portion of the force/movement curve and, on the basis of a modelling of the behavior of the piece in the plastic deformation zone, to deduce by extrapolation from this curve the point of maximum movement of the punch which, after elastic return, will give rise to a bending angle having the set value $\alpha_c$. This method has the advantage of taking account of the actual modulus of elasticity of the piece which is being bent. However, according to the value of the set angle, the model to be used for calculating the maximum movement of the punch is not the same. The accuracy of the correction of the bottom dead center therefore depends on the suitability of the model chosen as an approximation of the behavior of the actual piece.

The patent U.S. Pat. No. 4,511,976 describes a method in which an electronic control device records the variation in the angle θ between the sheet metal and the top of the die, measured by a position sensor which follows the deformation of the sheet metal, disposed on the fixed table, and the variation in the bearing force of the punch. The initial linear part of the curve F/θ makes it possible to calculate the modulus of elasticity of the sample and, by extrapolation from the curve in the plastic deformation zone, the control device calculates the maximum bending angle necessary for obtaining the set value of the bending angle in the absence of any load. However, experience shows that the measurement of the angle θ is not very precise and not very reliable, the sensors normally used for this type of measurement going out of adjustment little by little and having to be recalibrated for each die.

BRIEF SUMMARY OF THE INVENTION

The purpose of the present invention is to propose a method for adjusting the stroke of a press brake which compensates for the elastic return effect of the piece, without having the drawbacks of the prior methods.

This aim is achieved by a method of the type defined at the start in which the difference in thickness between the actual thickness ($e_r$) of the piece and the nominal thickness (e) of the piece is calculated by comparing the actual position of the movement of the punch at which there occurs a predetermined variation Δp in the physical parameter (p) with the theoretical position of the said movement where this variation Δp should occur, in which the electronic control device processes the measurements of the said movement (d) and the said physical parameter (p), during the plastic deformation phase of the piece during bending, so as to compare them and determine their differences with the data recorded during a reference bending operation which made it possible to obtain the set value $\alpha_c$ of the bending angle after release of the force exerted by the punch and to determine a reference value of the spring effect correction, and in which the electronic control device calculates a correction to the bottom dead center according to the said reference correction of the spring effect and the said differences with the reference recording data.

More particularly, according to the invention, the comparison with the reference recording is made by calculating the instantaneous bending angle α under load of the piece, according to the variation in the said movement (d) which follows the said variation Δp in the physical parameter, taking account of the said difference in thickness ($e_r$–e) and the geometric parameters of the punch and die. The bearing force (F) of the punch on the piece is calculated by means of the value of the physical parameter (p), the succession of values of the instantaneous bending angle/bearing force pair (α, F) is acquired and compared with a reference curve $(\alpha, F)_{ref}$ pre-recorded during the reference bending operation which made it possible to obtain the set value $\alpha_c$ of the bending angle after release of the force exerted by the punch, and the electronic control device calculates a correction to the bottom dead center according to the difference between the pairs (α, F) and the reference curve $(\alpha, F)_{ref}$.

The signals representing the movement (d) and the physical parameter (p) are measured, digitized and acquired as a series of isolated values of two parameters (p, d) or (α, F). However, to facilitate understanding of the description of the invention, they will be represented hereinafter graphically in the form of continuous curves according to the normal methods of analytical geometry. A person skilled in the art will easily understand that the expression "reference curve" is employed here for ease of language in order to designate a succession of parameter values recorded in digitized form. The numerical calculation methods equivalent to the graphical determination of the difference between two curves traced in a coordinate axis system are also sufficiently familiar to a person skilled in the art for it not to be necessary to repeat them here.

Using the movement of the moving beam and a parameter directly representing the bearing force of the punch on the piece as parameters recorded with a view to correction calculations, the method according to the invention avoids the use of unreliable angle measurement devices.

Using a previous recording of the bending of an actual sample of the same piece as data for making the correction to the bottom dead center, the method according to the invention avoids errors due to the use of inappropriate theoretical models.

Preferably, in comparing the bearing forces (F), account is taken of the actual length over which the piece is bent.

The simultaneous measurements of the movement of the moving beam and the variation in the physical parameter (p) making it possible to determine the difference between the actual thickness of the piece being bent and the nominal value of this thickness, the control device preferably makes a second correction to the bottom dead center whilst taking account of the difference in thickness thus determined.

According to a variant execution of this second correction, in order to improve its precision, the speed of the movement is reduced to a measurement acquisition speed (vam), less than the predetermined bending speed (VP), when the die is at a predetermined distance from the theoretical level of gripping the sheet metal, this distance being greater than the manufacturing thickness tolerance Δe of the said sheet metal, and the speed of movement increases once again up to the said bending speed after detection of the predetermined variation Δp in the said physical parameter (p).

Finally, the variation in the physical parameter (p) makes it possible to determine the mechanical forces to which the frame of the press is subjected, and therefore its deformation, and this on the basis of data relating to the machinery itself, stored in memory. This measurement of the forces can be used for calculating a third correction, representing the deformation of the press itself under the effect of these forces.

BRIEF DESCRIPTION OF THE DRAWINGS

Other particularities and advantages of the present invention will emerge from the following description of one embodiment, referring to the figures which accompany it, amongst which.

DETAILED DESCRIPTION OF THE INVENTION

Figure 2:
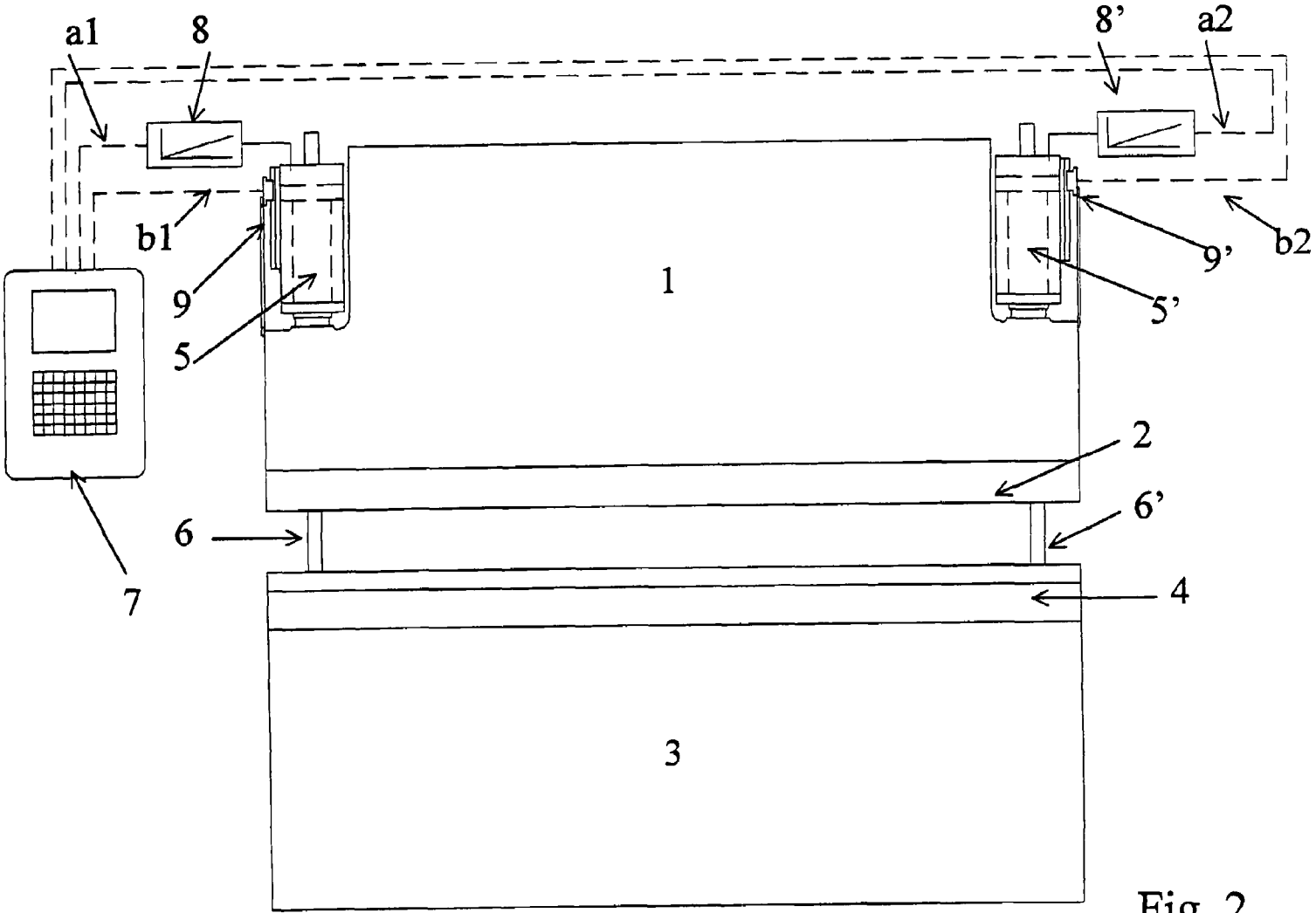
FIG. 2 is a schematic front view of a press brake provided with pressure sensors and control electronics.

The press brake depicted in FIG. 2 comprises a moving beam 1 supporting a punch 2 and a fixed table 3 supporting a die 4. Movement of the moving beam is effected by means of two hydraulic rams 5, 5', mounted on two respective uprights 6, 6' fixed to the bottom table. The machine is equipped with two measuring rules 9 and 9', mounted on each of its sides, in the bending axis, making it possible to measure the movement of the moving beam with respect to the respective uprights 6 and 6'. The bending movement is controlled by an electronic control device 7. Two pressure sensors 8 and 8' are mounted respectively on each of the rams 5, 5' so as to detect the pressure at the top part of each of them. The electronic control device is arranged so as to process the signals a1 and a2 issuing respectively from each of the pressure sensors and also to process two signals b1 and b2 issuing from the measuring rules 9 and 9' and representing the movements of the moving beam with respect to each of the uprights 6 and 6'. The mean of the signals b1 and b2 can be used as the measurement of the movement (d) and the mean of the signals a1 and a2 as the measurement of the parameter (p). For more information, it is however preferable to process separately the signals b1 and a1 on the one hand and the signals b2 and a2 on the other hand, in particular in order to take account of any lack of evenness on the piece to be bent, and to make correction calculations and compensations for the stroke of the moving beam separately at the left upright and the right upright. A person skilled in the art will easily understand that the following description illustrates both the calculations and stroke compensations for each of the two uprights taken separately, their respective signals being the subject of separate processings, and the calculations and compensations for averaged signals between the left upright and the right upright.

During the descent of the moving beam, as long as the punch has not come into contact with the metal sheet intended to be bent, the bearing force is zero. It can be represented by the pressure (p) measured by the sensors 8, 8', which has an initial value which can be measured and zeroed by calculation. After the punch comes into contact with the metal sheet, the variation in the bearing force is linear, during the elastic deformation of the metal sheet. The slope on the linear part of the curve p/d or on the curve F/α which is derived therefrom by mathematical conversion makes it possible to calculate the modulus of elasticity. The position of the moving beam to which the start of the variation in the physical parameter (p) corresponds makes it possible to calculate the actual thickness $e_r$ of the metal sheet. In order to determine this actual thickness more precisely, the descent of the beam can be controlled by the electronic control device according to a variant disclosed below and illustrated by FIG. 3.

Figure 3:
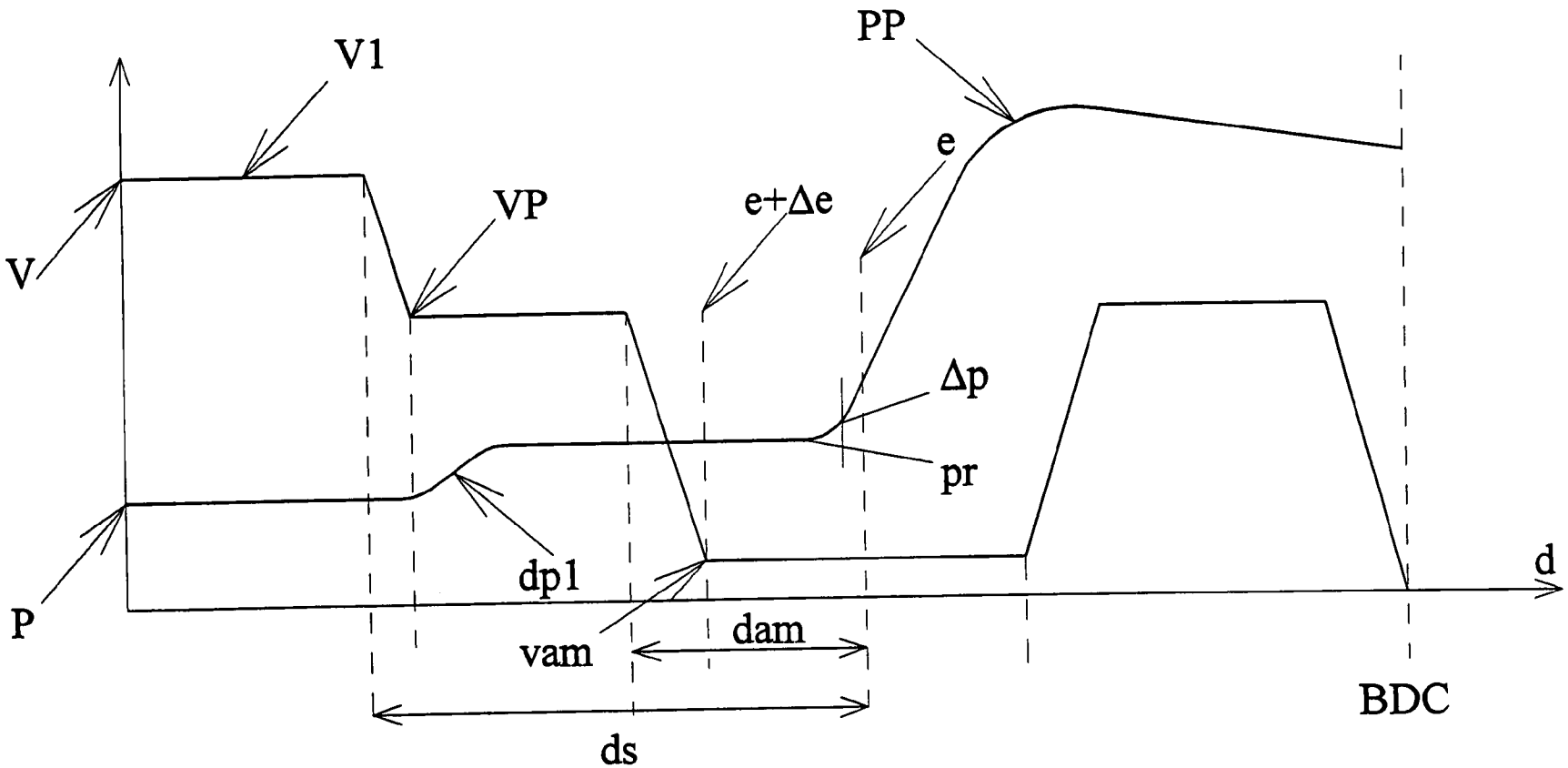
FIG. 3 shows two curves, illustrating simultaneously the descent of the punch and the variation in the parameter (p) according to the movement of this punch.

FIG. 3 shows, on the same diagram, on the one hand the speed of descent V of the moving beam, which is pre-programmed, and, at the same time, the variation in the hydraulic pressure P measured at the pressure sensors 8, 8', according to the movement (d). The descent takes place initially at a high approach speed V1, until it reaches a predetermined distance with respect to the level where the punch theoretically grips the metal sheet, referred to as the safety distance ds. At this moment, the speed is decreased, for example to a speed close to the bending speed VP, the latter being imposed by the composition and nominal thickness of the metal sheet as well as by the characteristics of the bending required, the bending angle and the punch profile. This speed can typically be around 10 mm/s. If the nominal thickness of the metal sheet is designated e, the tolerance on the thickness Δe, the actual thickness $e_r$ of the sheet will be in the range e±Δe. When the punch is at a distance from the theoretical gripping level, referred to as the measurement acquisition distance, dam, slightly greater than Δe, the speed of descent is reduced to a measurement acquisition speed, vam, which is around ½ to 1/10 of the bending speed VP, that is to say typically 1 mm/s–5 mm/s.

Throughout the descent, the pressure sensors 8 and 8' measure the hydraulic pressure P at each of the rams 5 and 5' and the control device 7 records it and processes it. The variation in the pressure is shown (in arbitrary units) in FIG. 3. The reduction in the descent speed of the moving beam, from the approach speed V1 to the bending speed VP, is accompanied by a slight increase in the concomitant pressure dp1, not significant with regard to the bending. The value of the pressure pr then reached, during the descent phase at the bending speed and before coming into contact with the metal sheet, is considered to be the reference value of this parameter. A measurement cycle of the assembly consisting of sensors+electronic control device lasts for approximately 10 ms: in this way, whilst the beam is descending at a bending speed VP of around 10 mm/s, a measurement of the pressure is carried out every 0.1 mm; when the descent speed is reduced to a measurement acquisition speed vam of 1 mm/s, a measurement of the pressure is carried out every 0.01 mm. The device is then in a position to determine very precisely the time when the pressure P increases once again by an amount Δp, representing the coming into contact of the punch with the top face of the metal sheet. A value of Δp of around 1 bar can be chosen. This coming into contact can occur at any point situated between the points representing respectively metal sheets with a thickness e+Δe and e−Δe. The comparison of the level of coming into contact with the theoretical gripping level determines the difference between actual and nominal thickness of the sheet and the control device 7 immediately recalculates a bottom dead center.

Once the level of the actual point of coming into contact of the punch with the metal sheet is acquired, the descent of the moving beam can be continued at the bending speed VP.

After the coming into contact, the pressure measured at the sensors 8, 8' increases almost linearly until it reaches a value PP, the bending pressure, which can attain the order of magnitude of 300 bar. Beyond this the plastic deformation of the piece occurs, the curve (d, P) curves downwards, and then the pressure P decreases slightly and linearly. The value of the pressure in this plastic deformation phase determines the deformation of the uprights and other fixed parts of the press. The electronic control device 7 compares the value of the pressure during the plastic deformation with a nomogram specific to this bending press, recorded in memory, establishing the relationship between this value, the deformation of the fixed parts of the pressure and the punch penetration error which would result therefrom, in the absence of any correction. The stroke of the punch, that is to say the position of the bottom dead center (BDC) is corrected accordingly.

Figure 1:
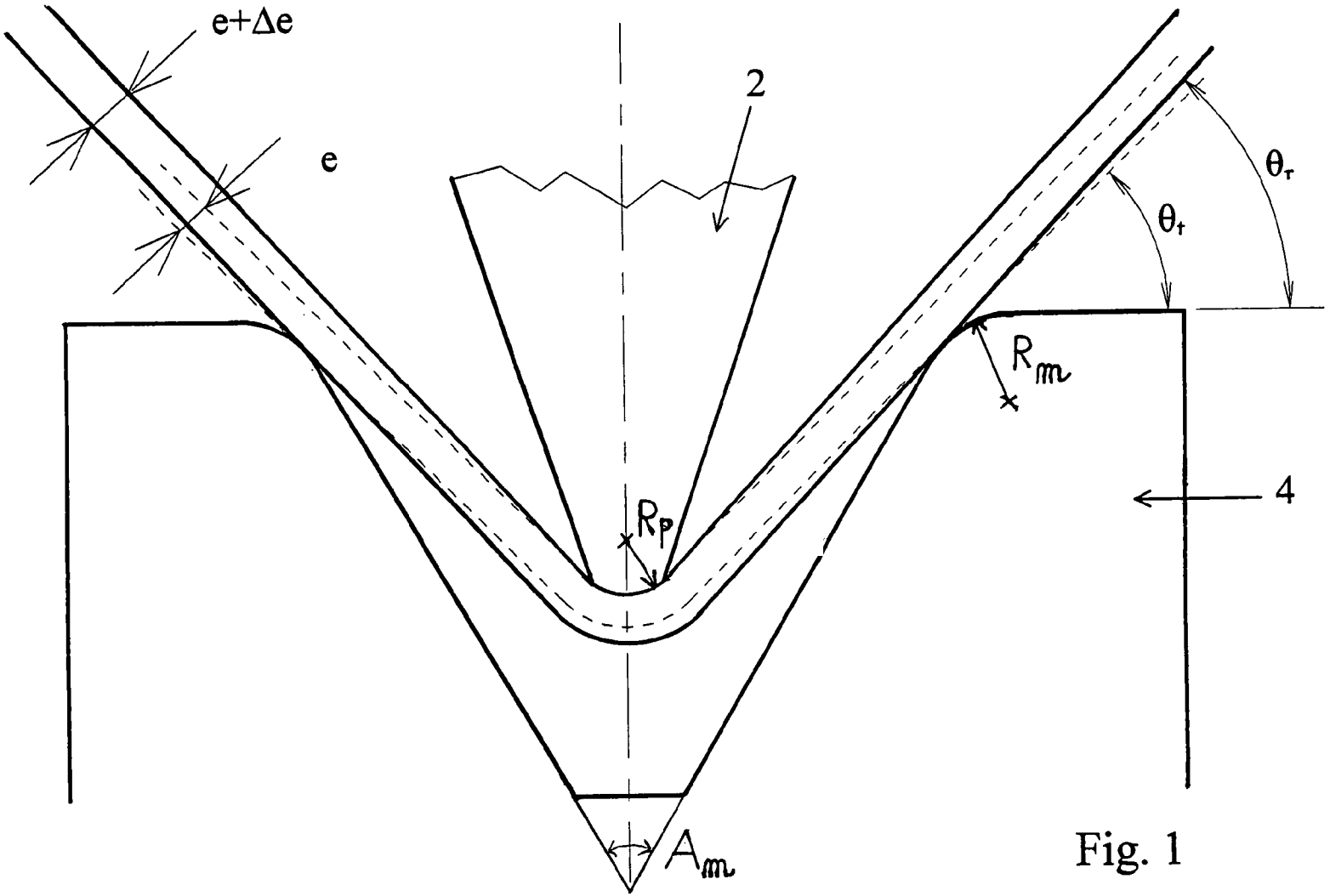
FIG. 1 is a schematic view illustrating the effect of a variation in thickness of a metal sheet on the point of contact between punch and metal sheet.

From the measured values of the movement d and the concomitant values of the parameter p, and taking account of the geometric data of the tools, that is to say of the punch and die, put in memory, as well as the value of the actual thickness of the metal sheet determined at the start of the bending process, the electronic control device calculates the successive values (α, F) of the instantaneous bending angle and of the bearing force. This conversion can be made by means of the following mathematical equations, in which, referring to FIG. 1:

V1 designates the die opening $A_m$ designates the angle of the die $R_m$ designates the radius of curvature of the die $R_p$ designates the radius of the punch $e_r$ designates the actual thickness of the piece to be bent $d_0$ designates the movement of the beam at the moment the punch comes into contact with the piece P designates the penetration of the punch into the die $$V2=V1+2\cdot R_m\cdot tg((180-A_m)/4)$$

$$\beta=(180-\alpha)/2$$

$$V_e=V2-2\cdot R_m\cdot \sin\beta$$

$$RNH=V_e/6{,}18$$

$R_i$=RNH or Rp, the highest value being adopted $$P=d-d_0-e_r$$

$$P=(V2/2)\cdot tg\beta-(R_m+R_i+e_r)(1-\cos\beta)/\cos\beta$$

Figure 4:
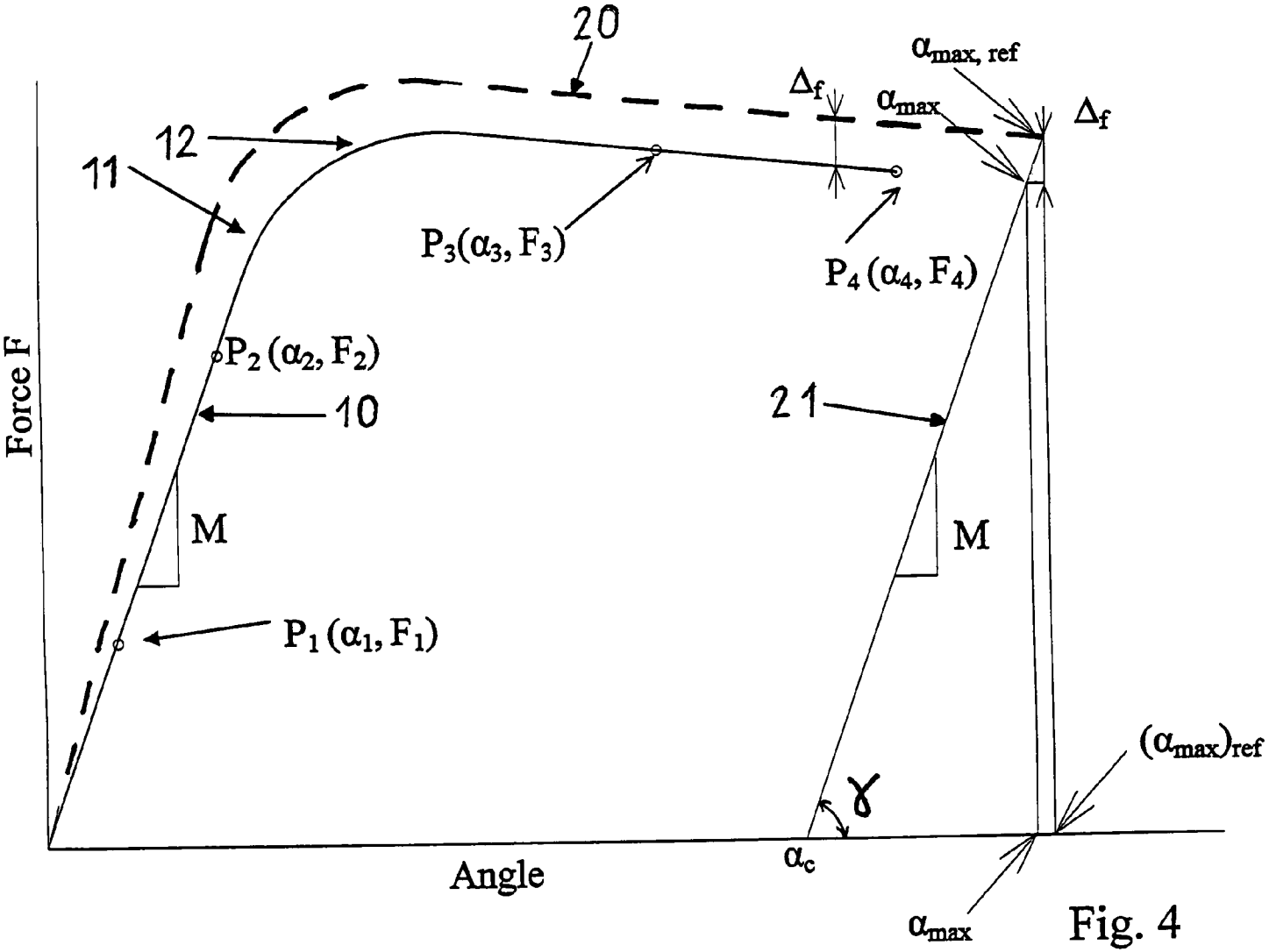
FIG. 4 shows two curves representing the variation in the bearing force F of the punch according to the bending angle, in a coordinate axis system (α, F)

The succession of values (α, F) can be represented in analogue form by the curve 10 shown in a solid line in FIG. 4.

Experience shows that, in the plastic deformation zone, the curve 10 becomes almost linear beyond its area of maximum curvature 11, 12. The method for calculating for the compensation for the swing effect is based on a comparison of the curve 10, represented by the values ($\alpha$, F) calculated as the bending operation progresses, with a reference curve 20, representing the values $(\alpha, F)_{ref}$ stored in memory during the bending of a metal sheet with a nominal thickness e and length $L_{ref}$. This reference curve 20, shown in a dotted line in FIG. 4, gives in particular the maximum value of the instantaneous angle under a load $(\alpha)_{max\ ref}$, which made it possible to obtain the set value $(\alpha)_c$ after the phase of releasing the bearing force exerted by the punch on the piece, illustrated by the straight-line segment 21.

Experience also shows that curves ($\alpha$, F) recorded during repeated bendings are practically parallel to each other in the almost linear part of the plastic deformation zone; in other words, they have a difference $\Delta f$ which practically does not vary as a function of a between the points $P_3$ and $P_4$. The position of the curves ($\alpha$, F) in this zone, above or below the reference curve 20, depends in particular on the differences between the actual length L of the bent pieces and the length $L_{ref}$, the actual thickness and the actual modulus of elasticity M of the bent sample. It may be noted that the unit of length of the bent piece, the force and the modulus of elasticity are connected by the equation $$F=e_r^2 \cdot M \cdot 1.75/V_e$$

The modulus of elasticity could also be determined from the slope between two points P1 and P2 on the linear part of the curve ($\alpha$, F) corresponding to the elastic deformation.

FIG. 4 also shows that, if the curve 10 is extrapolated, its intersection with the straight line 21, representing the spring effect, gives the bending angle $\alpha_{max}$ under force for the sample currently being bent, which makes it possible to obtain the set value $\alpha_c$ in the absence of any force. $\alpha_{max}$ is greater than $(\alpha_{max})$ ref if the bending curve is above the reference curve; $\alpha_{max}$ is less than $(\alpha_{max})$ ref in the contrary case.

In the method according to the invention, the measurements (p, d) are acquired, digitized and converted into torques ($\alpha$, F) by the electronic control device (7). The calculation of the correction of $(\alpha_{max})_{ref}$, that is to say $(\alpha_{max})_{ref}-\alpha_{max}$, is carried out without any graphical extrapolation: a plurality of values of F between the points $P_3$ and $P_4$ obtained as indicated above are first of all corrected by a factor $L/L_{ref}$. Then the difference $\Delta f$ between the curve portion 10 situated between $P_3$ and $P_4$ and the curve 20 is determined from values thus corrected by a least squares method. Next, the electronic control device calculates the corrected value of $\alpha_{max}$ from $(\alpha_{max})_{ref}$ and $\Delta f$. It is possible to use the equation:

$$(\alpha_{max})_{ref}-\alpha_{max}=\Delta f/tg\gamma$$

The angle $\gamma$ between the straight line 21 and the X axis is obtained by means of the recording of the reference curve 20 and pre-programmed for the bending operation.

Finally, the electronic control device calculates the corrected value of the bottom dead center from the equations indicated above between $\alpha$, d and P.

A person skilled in the art will note that this bottom dead center correction calculation is carried out during bending, well before the punch approaches bottom dead center, on the basis of torque measurements (p, d) carried out in a range of movement, namely between the points $P_3$ and $P_4$, which is easy to determine. The correction of the bottom dead center which compensates for the deformation of the press is carried out simultaneously. The correction which compensates for the variation in thickness of the piece is already carried out at this moment.

Figure 5:
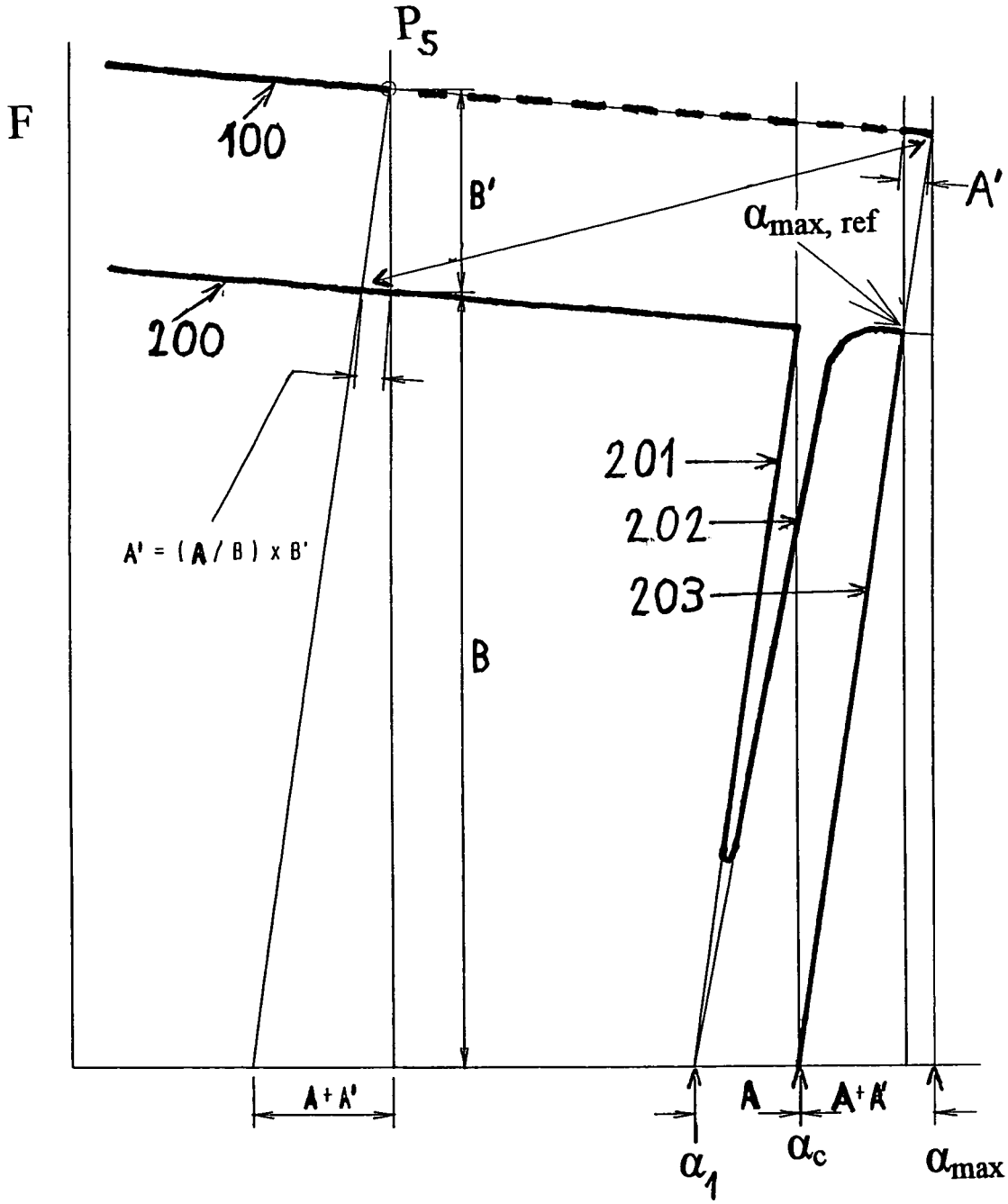
FIG. 5 is a partial view of two curves representing the variation in the bearing force of the punch according to the bending angle in a coordinate axis system (α, F).

The reference curve can be obtained by virtue of a first bending test as illustrated by FIG. 5. FIG. 5 depicts the plastic deformation zone of the test intended to supply the reference values of the correction of the spring effect. The bending represented by the curve 200 is carried out until the set value of the bending angle $\alpha_c$ is reached, but under force. The punch is then slightly raised, so that the bending angle of the piece decreases again under the spring effect. This process is represented by the segment 201 which cuts the X axis at a point $\alpha$1. The reference correction of the spring effect is therefore $A=\alpha_c-\alpha_1$. The punch is then made to redescend so as to continue the bending of the piece as far as a bending angle under force $\alpha_c$+A. The bearing force increases in accordance with the curve 202, first linearly and then in an arc of a curve corresponding to the end of plastic deformation. Then the punch is once again raised and the bearing force decreases in accordance with the straight-line segment 203. It is verified that the bending angle amounts to the value $\alpha_c$ in the absence of any force and that the segment 203 is parallel to the segment 201.

FIG. 5 also shows a subsequent bending using the data derived from the reference bending. At one moment in the plastic deformation phase of this bending, represented by the point $P_5$ on the curve 100, the corresponding ordinate B on the reference curve 200 and the difference B' between the ordinate of the point $P_5$ and the corresponding ordinate B on the reference curve are determined. As shown by the geometric construction of FIG. 5, the additional spring effect correction A', due to the difference B', is calculated by the expression $A'=(A/B)\cdot B'$. The whole of the angular spring effect correction applicable to the bending operation illustrated by the curve 100 is therefore A+A'. The control electronics convert this value into a correction of the bottom dead center by means of the algebraic expressions indicated above.

If the bendings subsequent to the reference bendings are carried out on the same machine and with the same tools, all the processing of the signals can be carried out by comparing the pairs (d, p) with a curve $(d, P)_{ref}$ recorded during a first bending, that is to say a curve similar to the right-hand half of the curve (d, P) in FIG. 3, without carrying out the mathematical conversion (d, p) $\leftrightarrow$($\alpha$, F). On the other hand, if the reference curve is recorded on a first machine, and the following bendings are carried out on another machine, this conversion is necessary in order to be able to make the comparisons and corrections described above.

The reference curve can be a data item stored in memory, obtained during previous work. In this case, when the initial programming of the bending is carried out, the electronic control device seeks in memory the existence of a reference curve for identical bending parameters and an identical material. The search in memory relates in particular to the set angle $\alpha_c$, the combination of tools and the physical parameters of the material (thickness and strength of the material).

A set of reference curves can constitute a database. This may be accessible on line to a plurality of users, either in the form of a public-access database or in the context of a private network.

The use of a reference curve derived from a database saves on a test on a first piece, which is a considerable advantage in the case of expensive small series.

The invention claimed is:

1. A method for adjusting the stroke of a press brake comprising a fixed table carrying a die, a moving beam carrying a punch, means of moving the moving beam bearing on uprights fixed to the fixed table, measuring rules for measuring a movement (d) of the moving beam with respect to the uprights, at least one sensor measuring a physical parameter (p) varying according to a force exerted by said punch on a piece placed on said die, and an electronic control device controlling the movement of the moving beam between a top dead center and a bottom dead center (BDC), provided with means of acquiring the movement measurements (d) and the physical parameter (p), and calculation means for correcting a value of the bottom dead center according to the measurements of said movement (d) and said physical parameter (p), wherein the difference in thickness between an actual thickness ($e_r$) of a sample of the piece to be bent and a nominal thickness (e) of the piece is calculated by comparing an actual position of the movement of the moving beam at which there occurs a predetermined variation Δp in said physical parameter (p) with a theoretical position of said movement (d) where this variation Δp should occur, wherein the electronic control device processes the measurements of said movement (d) and said physical parameter (p), during a plastic deformation phase of said sample of the piece during bending, so as to compare them and determine their differences with reference data pre-recorded during a reference bending operation which made it possible to obtain a set value $\alpha_c$ of the bending angle after release of the force exerted by the punch and to determine a reference value of a spring effect correction, and wherein the electronic control device calculates a first correction to the bottom dead center according to said reference value of the spring effect correction and to said differences with the reference data, wherein an instantaneous bending angle α under load of the piece is calculated according to a variation in said movement d, taking account of said difference in thickness ($e_r$–e) and geometric parameters of the punch and die, wherein a bearing force (F) of the punch on the piece is calculated by means of a value of the physical parameter (p), wherein the succession of values of a pair of parameters consisting of instantaneous bending angle and bearing force (α, F) is acquired and compared with a reference curve $(\alpha, F)_{ref}$ pre-recorded during a reference bending operation on a piece of the same material which made it possible to obtain the set value $\alpha_c$ of the bending angle after release of the force exerted by the punch, and wherein said electronic control device calculates a correction (A') of a maximum value of the instantaneous bending angle under load $(\alpha_{max})_{ref}$ determined during the reference bending according to the difference between the pair (α, F) issuing from the measurements and the reference curve $(\alpha, F)_{ref}$ in the plastic deformation phase.

2. A method according to claim 1, wherein the electronic control device calculates a correction to the bottom dead center (BDC) according to said correction (A') to the maximum value of the instantaneous angle under load $(\alpha_{max})_{ref}$.

3. A method according to claim 2, wherein a speed of movement of the moving beam is reduced to a measurement acquisition speed (vam), less than a predetermined bending speed (VP), when the punch is at a predetermined distance from a theoretical gripping level of the top of a metal sheet, this distance being greater than a manufacturing thickness tolerance Δe of said metal sheet, and wherein the speed of movement increases up to said bending speed after detection of said predetermined variation Δp in said physical parameter (p).

4. A method according to claim 1, wherein the electronic control device calculates a second correction to the bottom dead center (BDC) taking account of said difference in thickness between the actual thickness of the piece and the nominal thickness (e) of the piece.

5. A method according to claim 1, wherein the electronic control device compares the measured values of said physical parameter (p) with a pre-recorded nomogram establishing a relationship between said physical parameter and a deformation of the fixed parts of the press and calculates a third correction to the bottom dead center (BDC) taking account of said deformation of fixed parts of the press.

6. A method according to claim 1, wherein said physical parameter is a mechanical force that a ram exerts on the moving beam measured by a strain gauge.

7. A method according to claim 1, implemented in a press brake whose means of movement comprise two hydraulic rams associated respectively with one of the uprights and a pressure sensor associated with each ram, wherein said physical parameter is the average between hydraulic pressures measured by the said pressure sensors.

8. A method according to claim 1, implemented in a press brake whose movement means comprise two hydraulic rams associated respectively with one of the uprights and a pressure sensor associated with each ram, wherein the adjustment of the stroke is carried out for each upright, independently of the other, and wherein said physical parameter is the pressure measured respectively by each of the said pressure sensors.

* * * * *

UNITED STATES PATENT AND TRADEMARK OFFICE

CERTIFICATE OF CORRECTION

PATENT NO. : 7,079,919 B2
APPLICATION NO. : 10/472068
DATED : July 18, 2006
INVENTOR(S) : Gerrit Gerritsen et al.

It is certified that error appears in the above-identified patent and that said Letters Patent is hereby corrected as shown below:

Column 7, line 37:
greater than "($\alpha_{max}$) ref"--($\alpha_{max}$)$_{ref}$--if the bending curve is above the Column 7, line 38:
reference curve; $\alpha_{max}$ is less than "($\alpha_{max}$) ref"--($\alpha_{max}$)$_{ref}$--in the contrary Signed and Sealed this Thirty-first Day of October, 2006

JON W. DUDAS
*Director of the United States Patent and Trademark Office*